US008348632B2

(12) United States Patent
Soliz et al.

(10) Patent No.: US 8,348,632 B2
(45) Date of Patent: Jan. 8, 2013

(54) VARIABLE DISPLACEMENT COMPRESSOR SHAFT OIL SEPARATOR

(75) Inventors: Steven Craig Soliz, Dearborn Heights, MI (US); Christopher Carleton Bartholomew, Dearborn Heights, MI (US)

(73) Assignee: DENSO International America, Inc., Southfield, MI (US)

( * ) Notice: Subject to any disclaimer, the term of this patent is extended or adjusted under 35 U.S.C. 154(b) by 420 days.

(21) Appl. No.: 12/623,897

(22) Filed: Nov. 23, 2009

(65) Prior Publication Data

US 2011/0120176 A1 May 26, 2011

(51) Int. Cl.
*F04B 1/00* (2006.01)
*F04B 27/00* (2006.01)

(52) U.S. Cl. ..... 417/272; 92/154; 92/156; 184/6.17

(58) Field of Classification Search ..... 417/222.2, 417/272; 92/154, 153, 156; 184/6.17, 6.16, 184/5, 6, 18
See application file for complete search history.

(56) References Cited

U.S. PATENT DOCUMENTS 4,221,544 A * 9/1980 Ohta ..... 417/269
4,685,866 A * 8/1987 Takenaka et al. ..... 417/222.2
6,149,398 A 11/2000 Fukanuma et al.
6,402,480 B1 * 6/2002 Sud et al. ..... 417/222.1
6,481,240 B2 11/2002 Strikis et al.
6,497,114 B1 12/2002 Strikis et al.
6,511,297 B2 1/2003 Ota et al.
6,558,133 B2 * 5/2003 Fukanuma et al. ..... 417/222.2
6,742,439 B2 6/2004 Matsuda et al.
6,863,503 B2 * 3/2005 Matsuda et al. ..... 417/222.1
6,942,465 B2 * 9/2005 Kawachi et al. ..... 417/269
7,036,333 B2 * 5/2006 Schurig et al. ..... 62/279
7,179,063 B2 * 2/2007 Casar et al. ..... 417/269
7,204,098 B2 4/2007 Yamada et al.
7,458,785 B2 * 12/2008 Murakami et al. ..... 417/269
7,520,210 B2 * 4/2009 Theodore et al. ..... 92/71
8,038,415 B2 * 10/2011 Park et al. ..... 417/222.2
2003/0210989 A1 * 11/2003 Matsuoka et al. ..... 417/222.2
2004/0170504 A1 * 9/2004 Murakami et al. ..... 417/222.1

* cited by examiner

*Primary Examiner* — Devon Kramer
*Assistant Examiner* — Joseph Herrmann
(74) *Attorney, Agent, or Firm* — Harness, Dickey & Pierce, P.L.C.

(57) ABSTRACT

A compressor shaft has a fluid inlet that leads into a fluid inlet tube, is perpendicular to a longitudinal hole in the length of the shaft. An intermediate inlet into the longitudinal hole is located between the fluid inlet and an outlet at an end of the longitudinal hole. A drive plate mounted to the compressor shaft has a protruding drive arm, which uses a holding mechanism to connect to a swash plate. At certain swash plate angles, the intermediate inlet is covered and sealed by the swash plate, or uncovered. The drive arm defines an internal bore and a through slot. At opposite ends, the bore merges into the longitudinal hole and open into the through slot. The holding mechanism and/or swash plate guide covers the bore in the slot.

11 Claims, 7 Drawing Sheets

VARIABLE DISPLACEMENT COMPRESSOR SHAFT OIL SEPARATOR

FIELD

The present disclosure relates to an oil separator that separates oil from another fluid, such as a refrigerant in a compressor crank case.

BACKGROUND

This section provides background information related to the present disclosure which is not necessarily prior art. Compressors used to compress a refrigerant, such as R134a, in an air-conditioning system of a vehicle are known; however, such compressors are not without their share of limitations. One such limitation is the amount of heat stored within the compressor, which is created and held within a swash plate chamber (i.e. crank case) of a variable displacement air conditioning compressor. Prolonged subjection to heat may decrease the useful life of internal compressor parts and thus the useful life of the compressor. By controlling the volume of lubricating oil that is retained within the swash plate chamber, such as during specific volumes of compressor piston displacement, heat generated within the swash plate chamber may be controlled.

Another limitation of air conditioning compressors relates to the amount of oil that is permitted to be discharged from the compressor swash plate chamber and become resident within other components of an attached air conditioning refrigeration system, such as within a condenser and an evaporator. Oil that becomes resident in a condenser and an evaporator may decrease the cooling effectiveness of refrigerant passing through such components because a layer of oil within an internal cavity of such components decreases the heat transfer performance of such components and the overall cooling performance of the air conditioning system. What is needed then is a device that is capable of helping to retain oil within the compressor swash plate chamber when the compressor operates at prescribed compressor displacements.

SUMMARY

This section provides a general summary of the disclosure, and is not a comprehensive disclosure of its full scope or all of its features. A compressor apparatus for use in a vehicle air conditioning compressor may employ a compressor casing that defines a suction chamber, one or more compressor pistons that each define a working chamber with the compressor casing, and a control valve contained within the compressor casing. The control valve may be used for pressure control between the swash plate chamber and working chamber in order to determine a compressor displacement. The compressor apparatus may further employ a compressor shaft that may define an internal, longitudinal through hole from a first shaft end, such as near pulley retaining feature(s) (e.g. splines or threads) of the shaft, to a second shaft end. The longitudinal through hole at the second shaft end may define an outlet that provides fluid access (i.e. an exit) into the suction chamber.

The compressor shaft may further define a fluid inlet and a fluid inlet tube. The fluid inlet may be proximate the shaft splines and a lip seal, and the fluid inlet tube may be perpendicular to a non-exit end of the longitudinal through hole. The fluid inlet tube may fluidly link the fluid inlet and the longitudinal through hole. The shaft may also have an intermediate inlet located between the fluid inlet at the first shaft end and the fluid outlet at the second shaft end. A drive plate may be mounted to the compressor shaft with a drive arm protruding from the drive plate. A drive arm may further define an internal bore with a first bore end and a second bore end. The first bore end may merge into the longitudinal through hole to permit the flow of fluid (e.g. oil and refrigerant) to flow from the bore to the longitudinal hole and then to the suction chamber. The drive arm may further define a through slot, with the internal bore opening into the through slot.

The drive arm may also protrude from the drive plate to facilitate connection of a swash plate, which may employ a protruding swash plate guide. A slot in the drive arm may permit a holding mechanism (e.g. pin or shuttle) to secure the swash plate and swash plate guide to the drive plate and the pin is moveable within the slot when the swash plate changes position. The pin may cover the second end of the internal bore and create a seal. Alternatively, the swash plate guide may cover the second end of the internal bore and create a seal to prevent fluid flow into the bore. Still yet, the pin and the swash plate guide may together cover the second end of the internal bore and create a seal to prevent fluid flow into the bore. The intermediate inlet may be located under the swash plate such that the inlet may be sealed by the swash plate.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
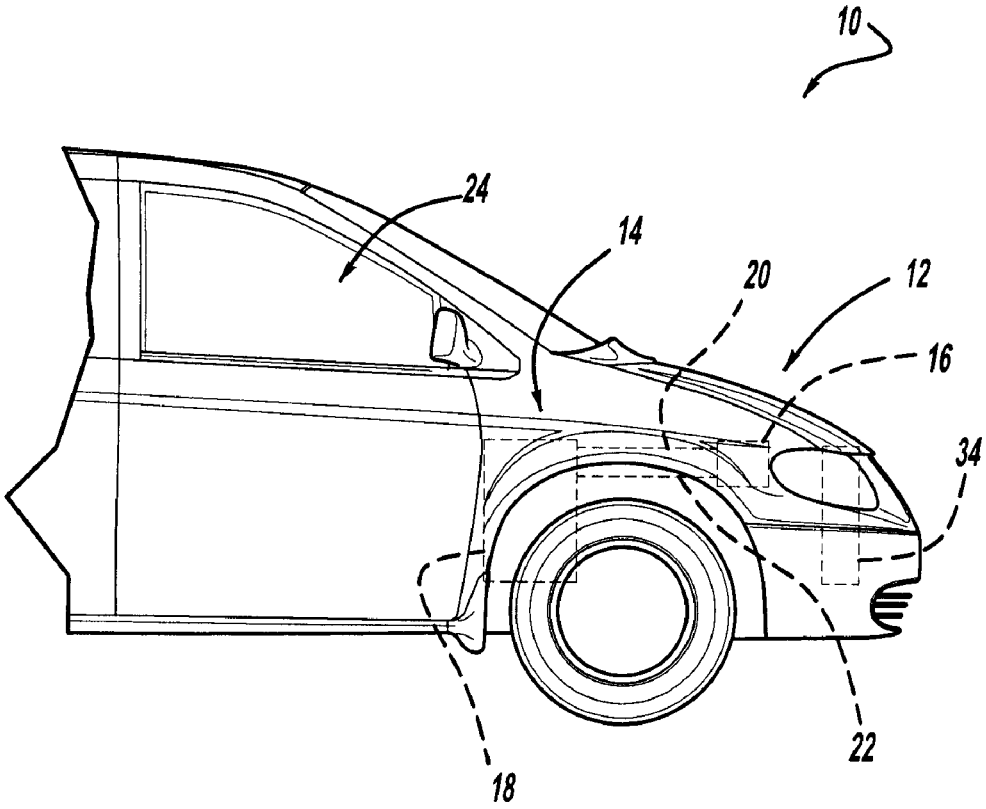
FIG. 1 is a side view of a vehicle depicting locations of various components of a vehicle air conditioning system.

Example embodiments of the present teachings will now be described more fully with reference to accompanying FIGS. 1-14. Referring initially to FIG. 1, a vehicle 10 may include an engine compartment 12 within which part of a heating, venting, and air conditioning (HVAC) system 14, depicted in phantom, may reside. HVAC system 14 may include an air-conditioning compressor 16, an HVAC unit 18, condenser 34 and hoses 20, 22 to connect compressor 16 to one or more components within HVAC unit 18. Vehicle 10 may include a passenger compartment 24, which HVAC system 14 may cool in a known manner.

Figure 2:
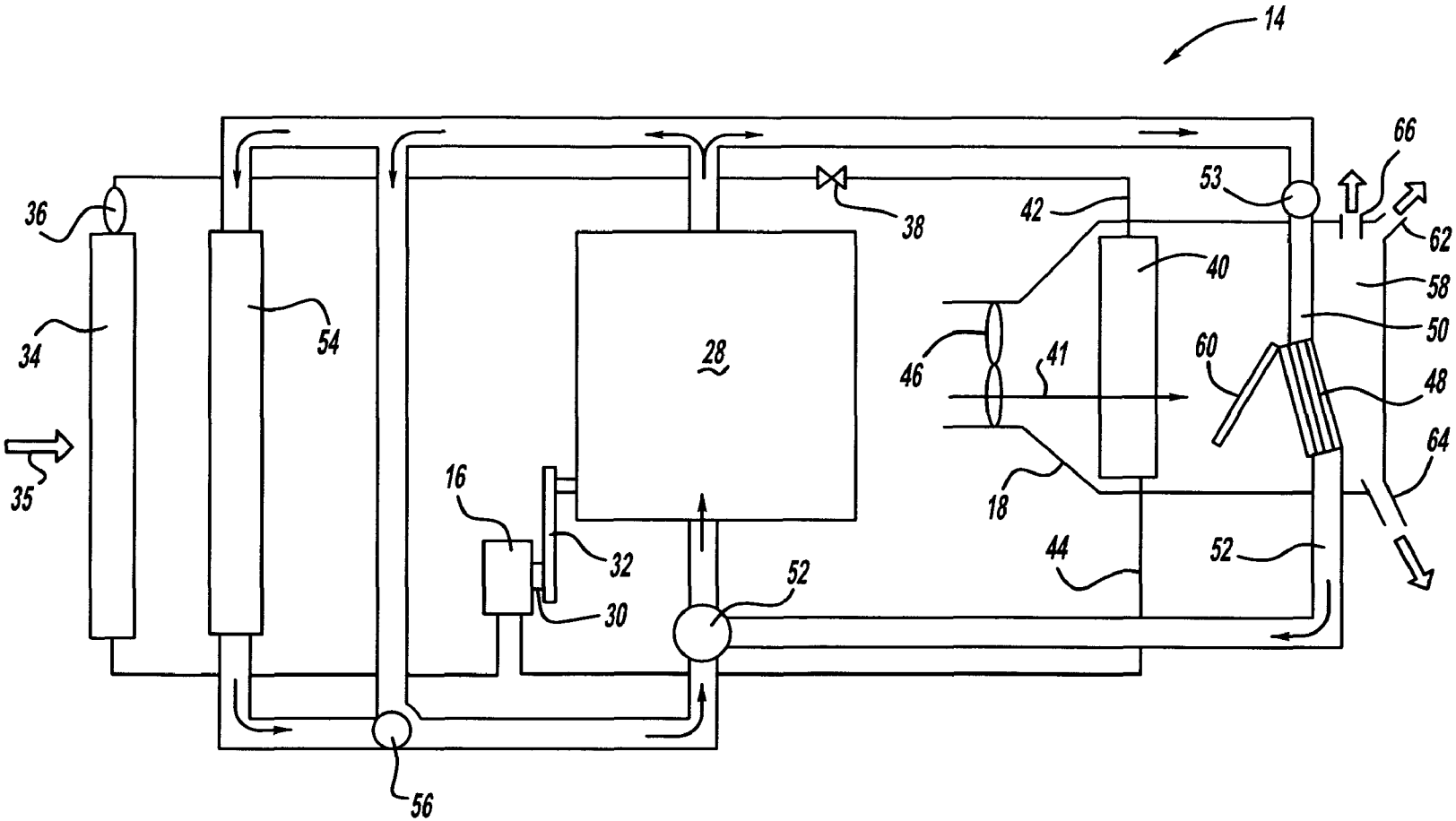
FIG. 2 is a schematic view of an arrangement of various components of a vehicle air conditioning system.

Turning now to FIG. 2, an HVAC system 14 represented by a schematic diagram, will be further explained. A refrigeration cycle of HVAC system 14 includes compressor 16 which draws, compresses, and discharges a refrigerant, such as R134a. The power of a vehicle engine 28 may be transmitted to compressor 16 through a pulley 30 and a belt 32 to enable compressor 16 to compress the refrigerant.

In HVAC system 14, compressor 16 may discharge a superheated gas refrigerant (e.g. R134a) at a high temperature and a high pressure, which flows into a condenser 34, where heat exchange is performed with outside (ambient) air 35, which may be forced by a cooling fan (not shown) so that the refrigerant is cooled before and during condensation. The refrigerant is condensed in condenser 34 then flows into a receiver 36

The liquid refrigerant from the receiver 36 is expanded by an expansion valve 38 into a gas-liquid double phase state of low pressure refrigerant fluid. The low pressure refrigerant from expansion valve 38 flows into an evaporator 40 by way of an inlet pipe 42. Evaporator 40 is arranged inside HVAC unit 18 of vehicle HVAC system 14. The low pressure refrigerant flowing into evaporator 40 absorbs heat from the air 41 inside the HVAC unit 18 as air 41 is passed over evaporator 40. Outlet pipe 44 of evaporator 40 may be connected to the suction side of compressor 16, so that the refrigeration cycle components mentioned above constitute a closed fluid circuit.

HVAC unit 18 forms a ventilation duct through which air conditioning air is sent into passenger compartment 24. HVAC unit 18 may contain a fan 46 that is arranged on the upstream side of the evaporator 40. An inside/outside air switch box (not shown) may be arranged on the suction side of fan 46, that is, the left side of fan 46 in FIG. 2, such that the air inside passenger compartment 24 (inside air) or the air outside passenger compartment 24 (outside air) may be alternated or mixed and introduced through the inside/outside air switch box and into the HVAC unit 18 by fan 46.

HVAC unit 18 accommodates, on the downstream side of evaporator 40, a hot water heater core (heat exchanger) 48, which may employ an inlet pipe 50 and an outlet pipe 52. Hot water (coolant) of vehicle engine 28 may be directed to heater core 48 through inlet pipe 50 by water pump 53. A liquid valve may control the flow volume of engine coolant supplied to the heater core 48 while a radiator 54 and a thermistor 56 further cooperate to control the temperature of the circulating liquid coolant.

A bypass channel 58 may be formed beside the hot water heater core 48 while an air mix door 60 may be provided to adjust the volume ratio between warm air and cool air that passes through the hot water heater core 48 and the bypass channel 58, respectively. Air mix door 60 may adjust the temperature of the air blown into passenger compartment 24 by adjusting the volume ratio between the warm air and cool air.

Additionally, a face outlet 62, a foot outlet 64, and a defroster outlet 66 are formed at the downstream end of the HVAC unit 18 such that face outlet 62 may direct air toward the upper body portions of passengers, foot outlet 64 may direct air toward the feet of the passengers, and defroster outlet 66 may direct air toward the internal surface of a vehicle windshield. Outlets 62, 64, 66 may be opened and closed by outlet mode doors (not shown). Air mix door 60 and the outlet mode doors mentioned above may be driven by such electric driving devices such as servo motors via linkages or the like.

Figure 3:
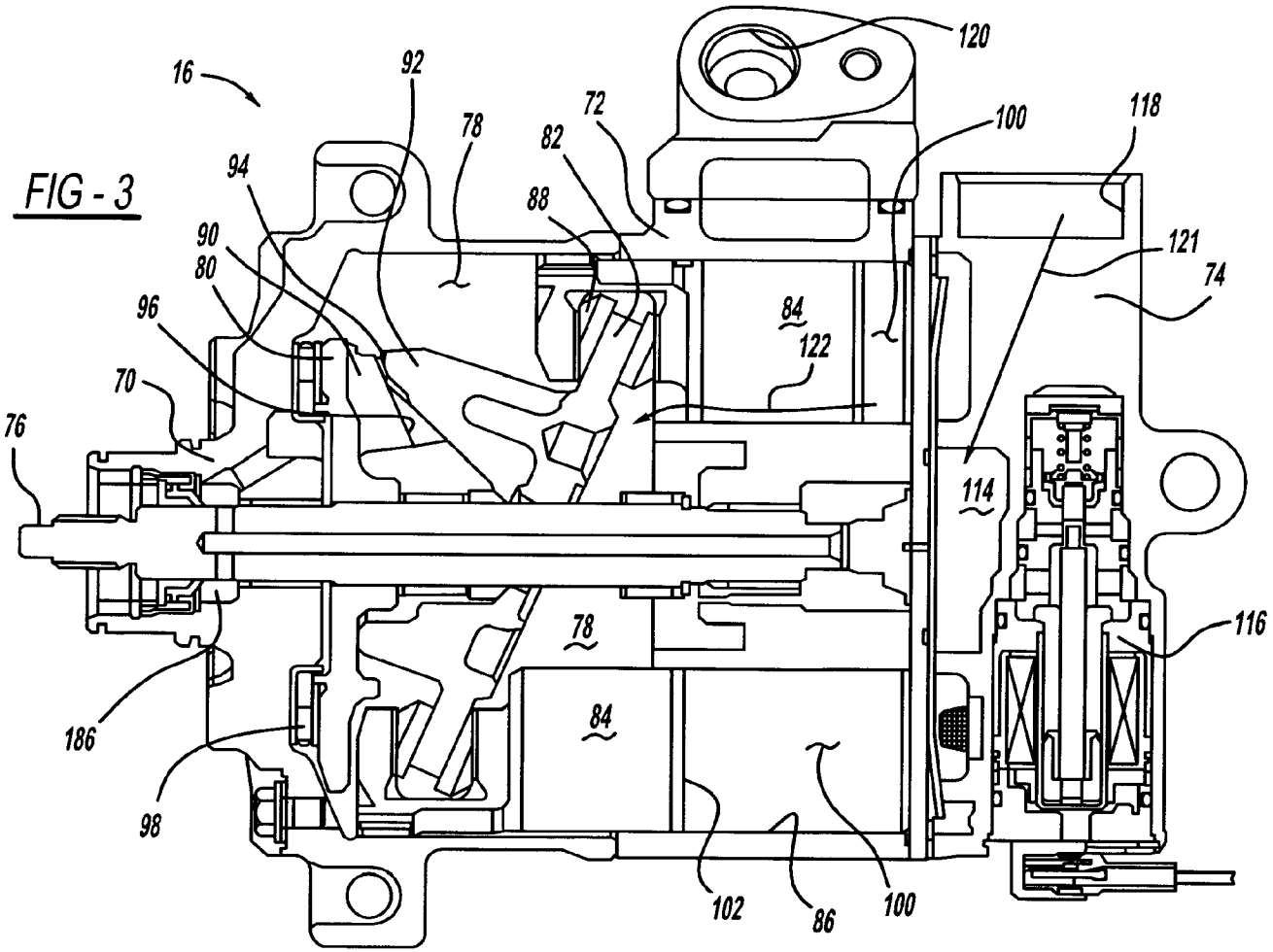
FIG. 3 is a cross-sectional view of an air conditioning compressor depicting a hollow shaft in accordance with the present disclosure.

With reference now including FIG. 3, compressor 16 is depicted in a cross-sectional view. As depicted, compressor 16 may be a swash plate type of variable displacement compressor. Compressor 16 may employ a front housing 70, a middle housing 72, and a rear housing 74, which all may be joined together by bolts, for example. A shaft 76 may pass through and be centered in a central portion of a swash plate chamber 78 defined by front housing 70, middle housing 72, and rear housing 74. Shaft 76 may serve as an input shaft with a drive plate 80 (also known as a lug plate) attached to shaft 76. A generally disk-shaped swash plate 82 may be loosely or pivotably installed around shaft 76 so as to be able to freely tilt or pivot with respect to the shaft 76, while also contacting shaft 76. Shaft 76 and swash plate 82 may freely rotate within swash plate chamber 78 and may cause one or more pistons 84 to reciprocate parallel to shaft 76 within cylinders 86, which are defined in part by middle housing 72 and rear housing 74. As an example, as many as six pistons 84 may be provided at equal or unequal intervals around the shaft 76. Swash plate chamber 78, also called a "control pressure chamber" may accommodate swash plate 82, and be formed in the area of the front housing 70 as a closed space.

Continuing with FIG. 3, a semispherical shoe 88 may fit into a corresponding semispherical recess formed in the end of each piston 84 and facilitate movement of each piston 84 with a corresponding periphery of swash plate 82. Alternatively, each semispherical shoe 88 may have one or more flat surfaces that abut a corresponding flat surface on a corresponding piston to facilitate piston movement. An arm 90 may be attached to and project out and away from drive plate 80. Swash plate 82 may further project out to arm 90 with an arm-like guide 92 provided with a guide surface 94 at its end to engage a surface 96 defined on end of arm 90. A thrust bearing 98 may support shaft 76 through drive plate 80 in the axial direction. Radial bearings (not shown) may be used to support shaft 76 in the radial direction. Continuing with FIG. 3, working chamber 100 may be formed by a flat surface or face 102 of piston 84 and either middle housing 72, or rear housing 74, for example, for compressing a fluid, such as a refrigerant (e.g. R134a) for an air-conditioning system.

Figure 4:
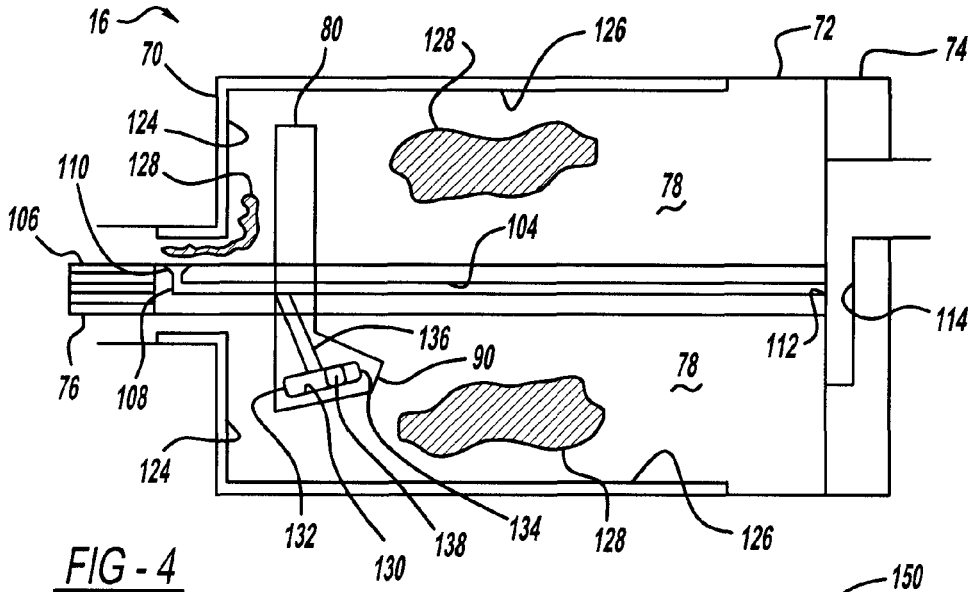
FIG. 4 is a schematic view of an air conditioning compressor depicting a hollow shaft in accordance with the present disclosure.

FIG. 4 is a schematic depicting compressor 16 utilizing a lug plate or drive plate 80 that is slightly different than that depicted in FIG. 3, while FIG. 4 depicts further details of shaft 76. More specifically, shaft 76 may define a longitudinal hole 104 or bore through its entire longitudinal length, or part of its longitudinal length. Longitudinal hole 104 may exist within shaft 76 from adjacent or near shaft splines 106 at front housing 70 to an opposite end of compressor 16 at rear housing 74. Hole 104 may pass through an end of shaft 76 at an end of shaft opposite splines 106, which may secure pulley 30 to shaft 76. Longitudinal hole 104 may be centered through shaft 76 and at front housing 70, an inlet hole 110 and an inlet tube 108 may provide access from swash plate chamber 78.

Inlet tube 108, may be chamfered or beveled to facilitate entry of oil (e.g. crankcase oil) and gas (e.g. refrigerant gas) of an oil rich area of swash plate chamber 78. From inlet hole 110, fluid may flow into inlet tube 108 and subsequently hole 104. Inlet tube 108 may be perpendicular to hole 104 and meet hole 104 at a right angle at an end of hole 104.

Continuing with reference to FIG. 4, upon oil and/or gas ("fluid") entering inlet 110 and traveling the entire length of hole 104, such fluid will exit hole 104 at outlet 112 and flow into a suction chamber 114. Accumulated fluid within suction chamber 114 may then be drawn back into working chambers 100 for compression by pistons 84 upon opening of chamber valves (not depicted). A control valve 116 (FIG. 3) may be confined within rear housing 74 and controlled to change the discharge capacity of compressor 16.

Additionally, fluid will flow into suction chamber 114 from compressor suction inlet 118 (FIG. 3) in accordance with arrow 121. Fluid in suction chamber 114 is drawn into working chambers 100 as one or more pistons 84 reciprocate. After being drawn into suction chamber 114 and undergoing compression in working chamber 100, a majority of the compressed fluid is forced out of compressor 16 via compressor discharge outlet 120 (FIG. 3). However, due to the compression of fluid by pistons 84 in working chamber 100, some fluid does not exit working chamber 100 via compressor discharge outlet 120, but rather by becoming "blow by" 122, which is the passage of fluid (e.g. refrigerant and oil) between an outside diameter of piston 84 and inside diameter of cylinder 86. Such blow by 122 discharges directly into swash plate chamber 78 and results in an accumulation of oil and refrigerant in swash plate chamber 78. The control valve 116 may also permit fluid from different circuits to enter the swash-plate chamber as well.

Droplets of oil and refrigerant may be continuously suspended in the atmosphere within swash plate chamber 78, at least while compressor 16 is rotating or being driven by pulley 30 via belt 32 (FIG. 2). Moreover, because shaft 76 and drive plate 80 rotate to invoke reciprocation of pistons 84 within cylinders 86, oil that accumulates on such rotating parts may be flung or transferred to the interior surfaces or walls of front housing 70, middle housing 72 and rear housing 74. The accumulation of oil on interior surfaces of front housing 70, middle housing 72 and rear housing 74 may be used in such a way to increase the cooling performance of HVAC system 14. Additionally, by manipulating the amount of oil within compressor 16, the useful life of compressor 16 may be extended.

FIG. 4 depicts how oil may be deposited on interior walls of compressor casing and compressor structure to redistribute accumulated oil. More specifically, FIG. 4 depicts front housing 70, middle housing 72 and rear housing 74 of compressor 16 with an accumulated layer of oil 124 on interior surface of front housing 70 and a layer of accumulated oil on interior surface of middle housing 72. When shaft 76 and drive plate 80 rotate causing oil to accumulate as layers of oil 124, 126, the atmosphere within swash plate chamber 78 may become laden with oil. In other words, atmosphere 128 within swash plate chamber 78 may become an atmosphere misty with oil and refrigerant. Although volumes of swash plate chamber 78 laden with oil are represented by atmospheres 128 in FIG. 4, in actuality, the entire swash plate chamber 78 may be laden or misty with oil.

Pump structure and pump operation to aid in redistribution of layers of oil 124, 126 and oil laden atmosphere 128 will now be presented. FIG. 4 depicts drive plate 80 with an arm 90 defining a slot 130 in arm 90. Slot 130, as depicted in FIG. 4, may not be parallel to shaft 76, and more specifically, slot 130 may have a slot end 132 that is farther from shaft 76 than a slot end 134. Additionally, slot end 132 may be closer to end of shaft 76 that retains pulley 30 than slot end 134. A bore 136 or orifice may reside within drive plate 80 and shaft 76 such that bore 136 creates a fluid path from longitudinal hole 104, through drive plate 80 and into arm 90 such that bore 136 opens to swash plate chamber 78 at an end opposite that end opening into longitudinal hole 104. Bore 136 is for transfer of oil and refrigerant resident within swash plate chamber 78, as will be explained later. A pin 138 may traverse within slot 130 while also securing swash plate 82 to drive plate 80.

Figure 5:
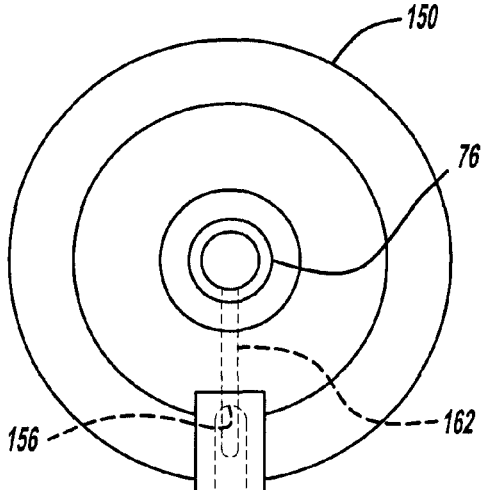
FIG. 5 is an end view of a compressor shaft in accordance with the present disclosure.
Figure 6:
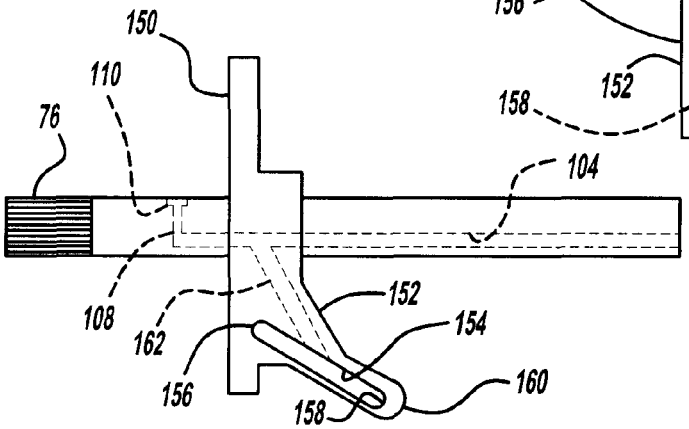
FIG. 6 is a side view of the compressor shaft of FIG. 5.
Figure 7:
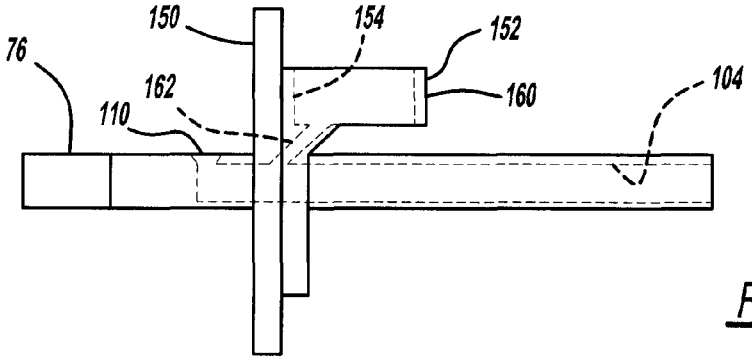
FIG. 7 is a side view of the compressor shaft of FIG. 5.

FIGS. 5-7 present a slightly different embodiment of a drive plate and accompanying arm. More specifically, drive plate 150 may have an arm 152 that protrudes away from drive plate 150 such that a slot 154 within arm 152 has a slot first end 156 that is closer to an end of shaft 76 that retains pulley 30 (FIG. 2) while a slot second end 158 lies farther away from an end of shaft 76 that retains pulley 30. Moreover, FIGS. 5-7 depict an embodiment such that an arm end 160 of arm 152 that is the farthest protruding end of arm 152, protrudes from drive plate 150 such that arm end 160 is farther from shaft 76 than any other portion of arm 152. A bore 162 permits fluid communication between longitudinal hole 104 and slot 154.

Figure 8:
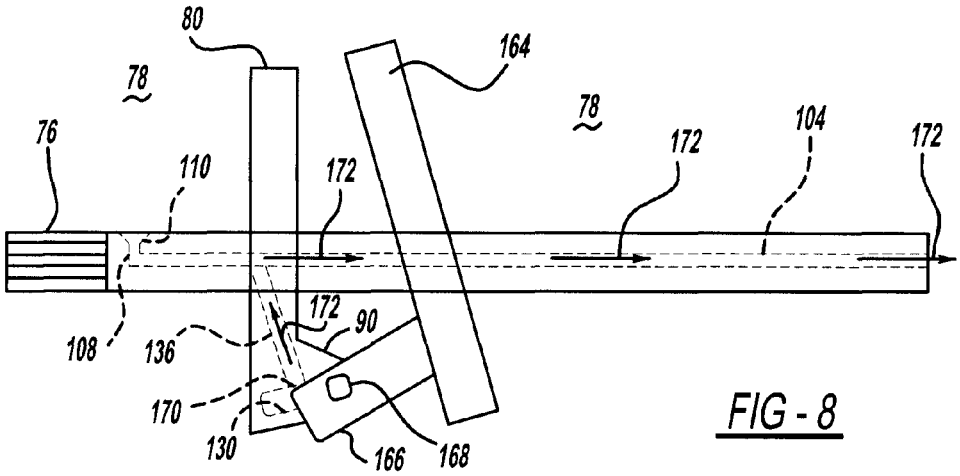
FIG. 8 is a side view of a compressor shaft depicting a swash plate pin in a first position in accordance with the present disclosure.

Turning now to FIG. 8, operation of compressor shaft 76 in conjunction with drive plate 80 and a corresponding swash plate 164 will be discussed. For ease of depiction regarding FIG. 8, the entire outer casing, or front housing 70, middle housing 72, and rear housing 74, of compressor 16 has been removed; however, FIG. 4 depicts a smaller scale view including front housing 70, middle housing 72, and rear housing 74, along with corresponding oil deposition on such housings and in the volume contained by such housings 70, 72, 74. Continuing, FIG. 8 depicts a swash plate 164 with a swash plate guide 166 protruding from swash plate 164 at a particular angle to swash plate 164.

Figure 9:
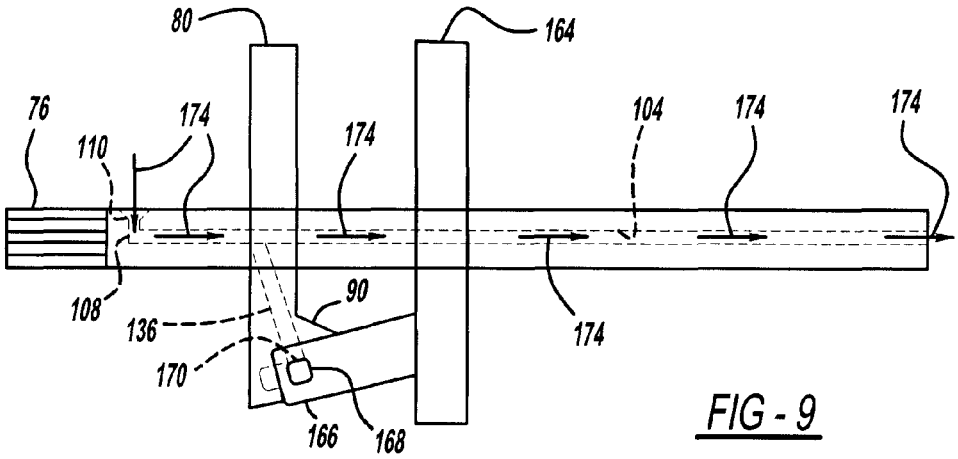
FIG. 9 is a side view of the compressor shaft of FIG. 8 depicting the swash plate pin in a second position.

With continued reference to FIG. 8, during operation of compressor 16, such as during maximum displacement of pistons 84 (FIG. 3), which may be evidenced by an angle that swash plate 164 forms with and relative to drive plate 80, swash plate guide 166 will move in accordance with pin 168 that couples or is attached to swash plate guide 166 and that also passes through slot 130 in arm 90 of drive plate 80. As pin 168 moves within slot 130, an end 170 of bore 136 may become covered and uncovered by pin 168 depending upon the displacement of pistons 84 as determined by cooling capacity desired. When end 170 of bore 136 becomes uncovered, fluid 172 indicated with arrows, is able to enter bore 136, flow into and through longitudinal hole 104 and into suction chamber 114 (FIG. 3). Alternatively, as depicted in FIG. 9, pin 168 may cover bore end 170, such as during reciprocation when swash plate 164 is at an angle with drive plate 80 that is different than that depicted in FIG. 8. Moreover, when end 170 of bore 136 is covered, the displacement of pistons 84 within compressor 16 is also different than that of FIG. 8. Thus, when end 170 of bore 136 is covered, fluid within swash plate chamber 78 is prevented from flowing into bore 136, which may cause fluid within swash plate chamber 78 to enter inlet 110, flow through inlet tube 108 and into longitudinal hole 104 and then into suction chamber 114 (FIG. 3).

While fluid (e.g. refrigerant and/or oil) may eventually enter longitudinal hole 104 via bore 136 or inlet tube 108, there is an advantage to fluid entering hole 104 via bore 136 at any given instances. Cooling performance of a vehicle air conditioning system may be maximized when oil from swash plate chamber 78 is maintained within swash plate chamber 78 and not distributed throughout air conditioning system, such as into condenser 34 and evaporator 40 after being compressed with refrigerant. More specifically, when lubricating oil within swash plate chamber 78 is drawn into suction chamber 114 and subsequently working chambers 100 of compressor 16, such oil is mixed with the refrigerant gas (e.g. R134a) of the air conditioning system and compressed. Upon compression, the oil and gas mixture is forced into condenser 34 and evaporator 40 and every other refrigerant passage of HVAC system 14. Because oil creates a liquid layer on the inside of all fluid passages, including condenser 34 and evaporator 40, such oil acts as a barrier that reduces the heat transferring performance of condenser 34 and evaporator 40. Thus, air conditioning cooling performance is reduced when oil is entering suction chamber 114 during operation of compressor 16. Thus, lowering the amount of oil entering suction chamber 114 at any given time, will improve cooling performance of HVAC system 14. Because maximum cooling performance, that is, the ability to provide the maximum amount of cooled or chilled air to a passenger compartment 24, is desired during periods of maximum or high compressor displacement (during maximum stroke of compressor pistons 84), reducing by as much as possible the volume of oil entering suction chamber 114 from swash plate chamber 78 is desirable. By reducing the volume of oil entering suction chamber 114 from swash plate chamber 78 and subsequently condenser 34 and evaporator 40, improved cooling may be experienced by HVAC system 14. Moreover, by retaining as much oil as possible within swash plate chamber 78, in comparison to a volume of oil that is drawn from swash plate chamber 78 and into suction chamber 114, the useful life of compressor 16 may also be extended since oil is a lubricant which reduces friction between compressor parts in contact.

During operation of compressor 16, as depicted in FIG. 4, liquid oil may coat or be deposited as layers of oil 124, 126 on compressor housings 70, 72, 74. Atmosphere 128 may be a blend of oil mist and refrigerant, but the concentration of oil may be less than deposited layers of oil 124, 126. As depicted in FIG. 8, when compressor 16 is undergoing high displacements, such as when maximum or near maximum cooling capacity is required, end 170 of bore 136 becomes uncovered and permits suction from "oil poor" atmosphere 128 and generally, swash plate chamber 78. As stated previously, because atmosphere 128 has a lower concentration of oil than layers of oil 124, 126, atmosphere drawn into hole 104 will be less laden with oil and thus, less oil will be drawn into suction chamber 114 from swash plate chamber 78 and subsequently, discharge outlet 120, condenser 34, and evaporator 40, thus improving heat transfer away from condenser 34 and evaporator 40 and thereby improving cooling performance of the HVAC system 14. Less oil is drawn into hole 104 because less oil is drawn in from "oil rich" areas 124, 126, such as at inlet 110 where oil is likely to fall onto shaft 76 after being flung on interior surface of the compressor casing. However, when piston displacement is reduced from a maximum or high displacement, to such as that depicted in FIG. 9, pin 168 may cover end 170 of bore 136 and permit suction chamber 114 to draw from inlet 110 proximate or near "oil rich" area 124, 126, as indicated by arrows 174. Gravity may cause liquid oil to drip from areas 124, 126 onto or near inlet 110. An advantage of drawing oil and refrigerant at inlet 110, such as during high speeds (e.g. maximum compressor speed or that speed set as a maximum, but at a piston displacement that is less than maximum) is that oil will be removed from swash plate chamber 78 and thus permit less heat to be retained by compressor 16. By retaining less heat, the useful life of compressor 16 may be extended. When compressor 16 is drawing fluid via inlet 110, compressor 16 may be reciprocating at a displacement that is less than maximum although compressor speed may be at a maximum or near maximum. Thus, because compressor displacement is not at a maximum or at most, near a maximum, maximum cooling performance in terms of oil in condenser 34 and evaporator 40 may not be as important.

Figure 10:
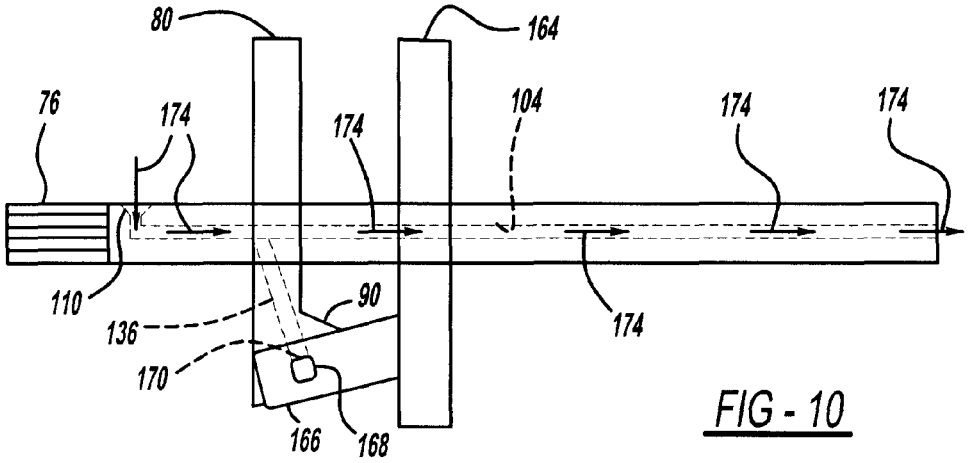
FIG. 10 is a side view of the compressor shaft of FIG. 8 depicting the swash plate connection in a second position.
Figure 11:
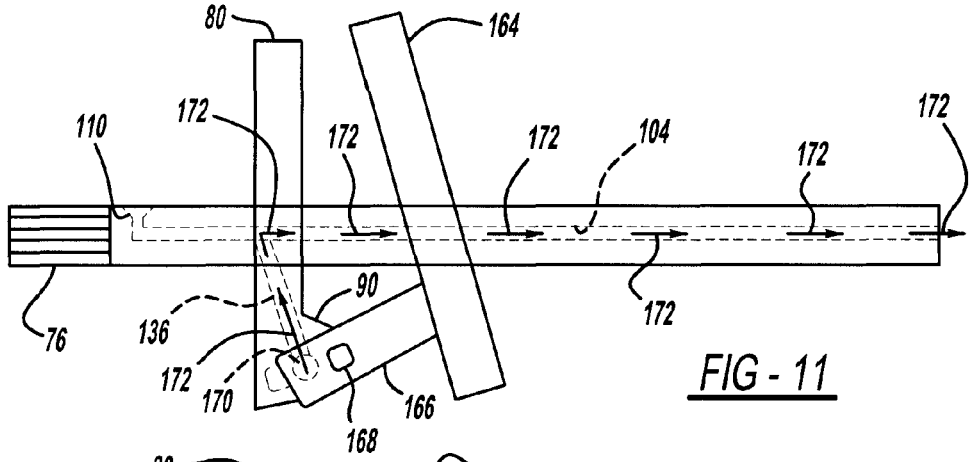
FIG. 11 is a side view of the compressor shaft of FIG. 8 depicting the swash plate connection in a first position.

Turning now to FIGS. 10-11, another embodiment of the teachings will be presented. FIGS. 10-11 depict a structure similar to that depicted in preceding figures; however, FIGS. 10-11 depict a structure in which swash plate guide 166, also known as a swash plate connection, may open (i.e. uncover) and close (i.e. cover) end 170 of bore 136 to permit or not permit the flow of fluid to longitudinal hole 104 as swash plate reciprocates to cause pistons 84 to move within cylinders 86. In order to achieve covering and uncovering of end 170 of bore 136, the angle at which swash plate guide 166 makes with swash plate 164, such as in the side views depicted in FIGS. 10-11, may be different than that depicted in FIGS. 8-9, when only pin 168 is used to cover and uncover end 170.

Figure 12:
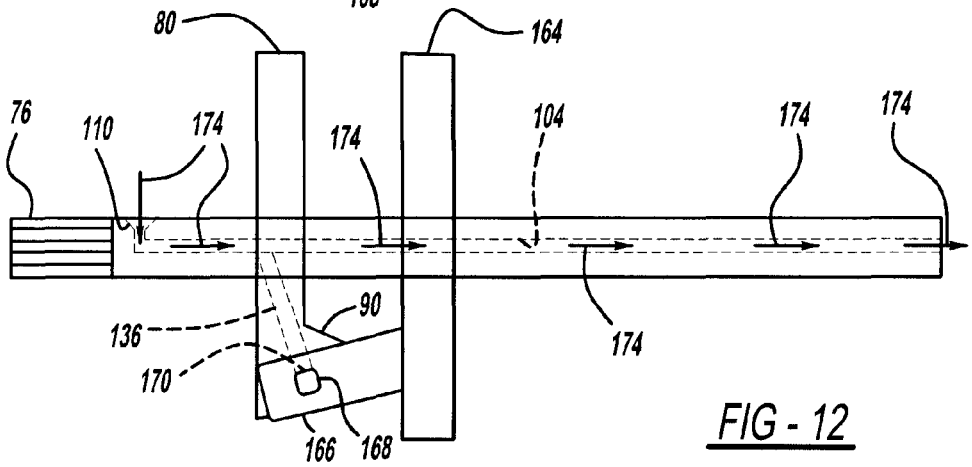
FIG. 12 is a side view of the compressor shaft of FIG. 8 depicting the swash plate connection and swash plate pin being concurrently positioned in a first position.

FIG. 12 depicts another embodiment in which pin 168 and swash plate guide 166 both, as opposed to individually as discussed above, may be used to cover and uncover end 170 of bore 136 to control the flow of fluid (i.e. oil and refrigerant) to longitudinal bore 104 and subsequently suction chamber 114. Similar to a prior embodiment, the angle at which swash plate guide 166 makes with swash plate 164, such as in the side view depicted in FIG. 12, may be different than that depicted in FIGS. 8-11, to achieve covering and uncovering of bore 136 at end 170 by pin 168 and swash plate guide 166.

Figure 13:
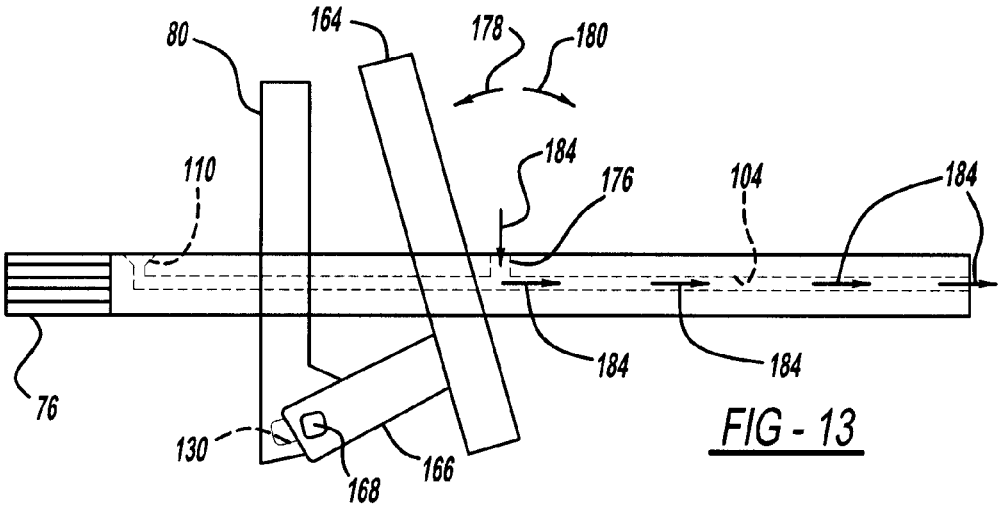
FIG. 13 is a side view of a compressor shaft depicting an intermediate inlet through the shaft wall in accordance with the present disclosure.

Turning now to FIG. 13, an intermediate inlet 176 is present between inlet 110 and suction chamber 114. More specifically, intermediate inlet 176 is located in the path of travel of swash plate 164 such that swash plate 164 is cable of covering intermediate inlet 176 so that fluid is not able to flow into or out of intermediate inlet 176. Continuing, when swash plate 164 reciprocates to move pistons 84, swash plate 164 may pivot using pin 168 within slot 130 and also move in accordance with arrows 178, 180. Movement by swash plate 164 will cause the covering and uncovering of intermediate inlet 176 by a wall or surface 182 of swash plate 164. When intermediate inlet 176 is covered, fluid will not flow into intermediate inlet 176 and when inlet is not covered, fluid may flow into intermediate inlet 176. FIG. 13 depicts a position of swash plate 164 that during reciprocation permits maximum or near maximum displacement of pistons 84 and also uncovers intermediate inlet 176. When intermediate inlet 176 is uncovered, oil is permitted to enter intermediate inlet 176 from oil poor area 128 of swash plate chamber 78, as indicated by arrows 184. That is, when uncovered, intermediate inlet 176 will draw as little oil as possible into longitudinal bore 104 so that oil remains in swash plate chamber 78, and does not coat or build up on internal passages of condenser 34 and evaporator 40 to hinder heat transfer during maximum or near maximum displacement of compressor 16, as previously described. As depicted in FIG. 13, inlet 110 may be open at the same time as intermediate inlet 176; however, because intermediate inlet 176 is closer to suction chamber 114 than inlet 110, intermediate inlet 176 represents an inlet of greater suction force and thus, suction is more likely to take place at intermediate inlet 176 than inlet 110.

Figure 14:
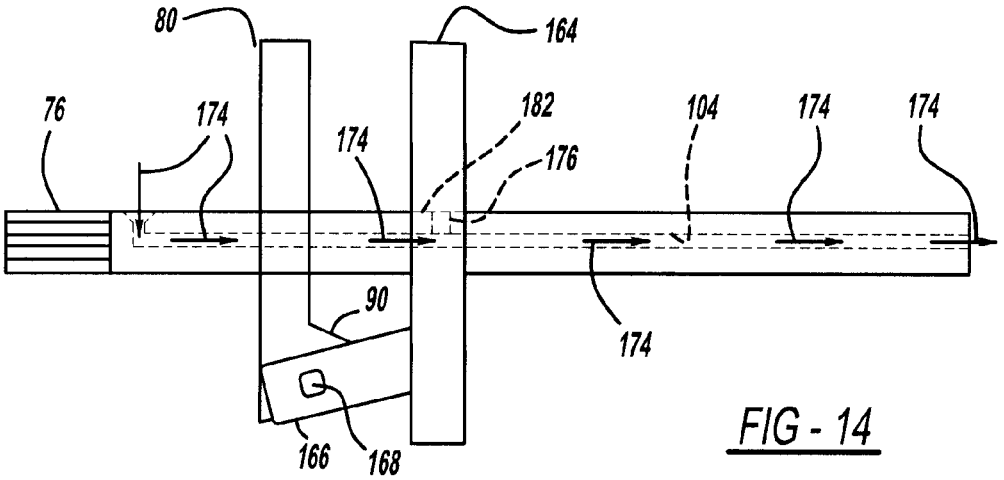
FIG. 14 is a side view of a compressor shaft depicting an intermediate inlet through the shaft wall in accordance with the present disclosure.

FIG. 14 depicts intermediate inlet 176 being covered by wall 182 of swash plate 164 when swash plate 164 is located over, that is, against a perimeter of, intermediate inlet 176. More specifically, surface of wall 182 of swash plate 164 effectively creates a seal around intermediate inlet 176 such that fluid is not able to flow into intermediate inlet 176. Relative to position of swash plate 164 depicted in FIG. 13, swash plate 164 depicted in FIG. 14 is positioned to invoke less displacement of pistons 84, and as a result, swash plate 164 may be positioned over intermediate inlet 176. Thus, fluid 174 may be drawn into inlet 110, beside lip seal 186 (FIG. 3) which is an oil rich area. Thus, because compressor displacement is not at maximum or high in FIG. 14, drawing oil and refrigerant from an "oil rich" area of swash plate chamber 78 is acceptable, and thus fluid 174 in the form of oil and refrigerant is drawn into inlet 110, while intermediate inlet 176 is closed or sealed to effectively prevent drawing or suction at intermediate inlet 176.

Further explanation of operation of a vehicle air conditioning system, including adjustment of a variable displacement, swash plate type of air conditioning compressor, may be found in U.S. Pat. No. 6,863,503, which is herein incorporated by reference.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A compressor apparatus comprising:

a compressor casing comprising a front housing, a middle housing, and a rear housing, the rear housing defining a suction chamber;

a compressor shaft defining a longitudinal hole, the longitudinal hole being open at a first shaft end, which is secured in the front housing, and extending toward a second shaft end, which is secured in the middle housing, the longitudinal hole at the second shaft end defining an outlet always open directly to the suction chamber;

a drive plate mounted to the compressor shaft; and a drive arm protruding from the drive plate; wherein the drive arm further defines an internal bore with a first bore end and a second bore end, the first bore end merging with the longitudinal hole;

the drive arm further defines a through slot; and the internal bore opens into the through slot; wherein the through slot is open to the suction chamber when the compressor is undergoing high displacement and the through slot is closed to the suction chamber when the compressor is undergoing low displacement, the low displacement being less than the high displacement.

2. The compressor apparatus according to claim 1, wherein the shaft further defines a fluid inlet proximate the first shaft end and a fluid inlet tube proximate the first shaft end, wherein the fluid inlet tube is approximately perpendicular to the longitudinal hole and is a fluid conduit that fluidly links the fluid inlet and longitudinal hole.

3. The compressor apparatus according to claim 1, further comprising:

a swash plate;

a swash plate guide protruding from the swash plate; and a holding mechanism, wherein the holding mechanism resides in the through slot and secures the swash plate and swash plate guide to the drive plate.

4. The compressor apparatus according to claim 3, wherein the holding mechanism is moveable within the through slot when the swash plate changes position.

5. The compressor apparatus according to claim 4, wherein the holding mechanism covers the second bore end of the internal bore and creates a seal.

6. The compressor apparatus according to claim 5, wherein the swash plate guide covers the second bore end of the internal bore and creates a seal.

7. A compressor apparatus comprising:

a compressor casing defining a suction chamber;

a piston defining a working chamber with the compressor casing;

a control valve contained within the compressor casing;

a compressor shaft defining a longitudinal hole, the longitudinal hole being open at a first shaft end and extending to a second shaft end, the longitudinal hole at the second shaft end defining an outlet always open directly into the suction chamber;

a drive plate mounted to the compressor shaft; and a drive arm protruding from the drive plate, wherein the drive arm further defines an internal bore with a first bore end and a second bore end, and the first bore end merges into the longitudinal hole;

the drive arm further defines a through slot; and the internal bore opens into the through slot; wherein the through slot is open to the suction chamber when the compressor is undergoing high displacement and the through slot is closed to the suction chamber when the compressor is undergoing low displacement, the low displacement being less than the high displacement.

8. The compressor apparatus according to claim 7, wherein the shaft further defines a fluid inlet and a fluid inlet tube, the fluid inlet tube approximately perpendicular to the longitudinal hole at the first end of the longitudinal hole, the fluid inlet tube fluidly linking the fluid inlet and the longitudinal hole.

9. The compressor apparatus according to claim 7, further comprising:

a swash plate;

a swash plate guide attached to the swash plate;

a holding mechanism, wherein the holding mechanism secures the swash plate and swash plate guide to the drive plate and the holding mechanism moves within the through slot when the swash plate changes position.

10. The compressor apparatus according to claim 9, wherein the holding mechanism covers the second bore end of the internal bore and creates a seal.

11. The compressor apparatus according to claim 10, wherein the swash plate guide covers the second bore end of the internal bore and creates a seal.

* * * * *